US011747750B2

(12) United States Patent
Meguro

(10) Patent No.: US 11,747,750 B2
(45) Date of Patent: Sep. 5, 2023

(54) CLEANING APPARATUS, IMAGE FORMING APPARATUS, AND STORAGE MEDIUM

(71) Applicant: Konica Minolta, Inc., Tokyo (JP)

(72) Inventor: Taichi Meguro, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 31 days.

(21) Appl. No.: 17/701,527

(22) Filed: Mar. 22, 2022

(65) Prior Publication Data

US 2022/0317598 A1 Oct. 6, 2022

(30) Foreign Application Priority Data

Apr. 6, 2021 (JP) ..... 2021-064502

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS 6,185,394 B1 * 2/2001 Lee ..... G03G 15/754 399/116
2009/0304402 A1 * 12/2009 Thayer ..... G03G 21/203 399/350

FOREIGN PATENT DOCUMENTS

JP 2016-057492 A 4/2016
JP 2019-128426 A 8/2019

* cited by examiner

*Primary Examiner* — Stephanie E Bloss
*Assistant Examiner* — Michael A Harrison
(74) *Attorney, Agent, or Firm* — Squire Patton Boggs (US) LLP

(57) ABSTRACT

A cleaning apparatus includes a plate shaped cleaner that comes into contact with a belt shaped member that rotates supported by a roller in a position not opposed to the roller in a surface on an opposite side of a surface where the roller comes into contact with the belt shaped member, wherein the plate shaped cleaner cleans the surface of the belt shaped member, and a hardware processor. The hardware processor obtains an amount of use of the plate shaped cleaner for each belt tension state in the belt shaped member in which the belt tension state is switched. The hardware processor sets a replacement determination timing of the plate shaped cleaner based on the obtained amount of use of the plate shaped cleaner.

16 Claims, 11 Drawing Sheets

FIG.4A

| AMOUNT OF USE OF PLATE SHAPED CLEANER IN FIRST STATE [kp] | EVALUATION OF CLEANING PROPERTIES IN SECOND STATE |
|---|---|
| 200kp | ○ |
| 400kp | ○ |
| 600kp | × |
| 800kp | × |

MAXIMUM AMOUNT OF USE IN FIRST STATE : 400kp

FIG.4B

| AMOUNT OF USE OF PLATE SHAPED CLEANER IN SECOND STATE [kp] | EVALUATION OF CLEANING PROPERTIES MAINTAINING SECOND STATE |
|---|---|
| 600kp | ○ |
| 800kp | ○ |
| 900kp | ○ |
| 1000kp | × |

MAXIMUM AMOUNT OF USE IN SECOND STATE : 900kp

| | | AMOUNT OF USE OF INTERMEDIATE TRANSFER BELT [kp] | | | |
|---|---|---|---|---|---|
| | | NEW | 400 | 600 | 800 |
| ABSOLUTE HUMIDITY | LESS THAN 10.3g/m$^3$ | 1 | 1 | 1 | 0.97 |
| | EQUAL TO OR MORE THAN 10.3g/m$^3$, LESS THAN 14.6g/m$^3$ | 1 | 1 | 1 | 0.95 |
| | EQUAL TO OR MORE THAN 14.6g/m$^3$ | 1 | 0.95 | 0.9 | 0.85 |

CLEANING APPARATUS, IMAGE FORMING APPARATUS, AND STORAGE MEDIUM

CROSS-REFERENCE TO RELATED APPLICATIONS

The entire disclosure of Japanese Patent Application No. 2021-064502 filed on Apr. 6, 2021 is incorporated herein by reference in its entirety.

BACKGROUND

Technological Field

The present invention relates to a cleaning apparatus, an image forming apparatus, and a storage medium.

Description of the Related Art

Conventionally, there is a known electrophotographic image forming apparatus in which an electrostatic latent image formed on a photoreceptor is developed with toner to form a toner image. The formed toner image is transferred on a sheet with a transfer unit, and the transferred toner image is fixed with a fixer. With this, an image is formed on a sheet.

In the electrophotographic method, as a method to clean the intermediate transfer belt, there is a technique to use a plate shaped cleaner. Specifically, a stationary layer is formed on an edge of the plate shaped cleaner with an external additive added to the toner, and the stationary layer holds up the toner to perform the cleaning.

The surface of the plate shaped cleaner in contact with the intermediate transfer belt wears down with use, and such wear causes defects in cleaning.

Therefore, the plate shaped cleaner is replaced at a suitable timing before defects in cleaning occur.

Regarding the timing that the plate shaped cleaner is replaced, JP 2019-128426 describes an image forming apparatus including a blade that cleans a surface of an intermediate transfer belt, an urging spring that changes the condition of the blade with relation to the intermediate transfer belt, and a sensor that detects defects in cleaning that occur depending on an amount of toner on the intermediate transfer belt, and the blade is replaced based on the result detected by the sensor.

JP 2016-57492 describes a cleaning apparatus including a plate shaped cleaner in which one end side comes into contact with an outer circumference surface of a rotating cleaning target, which removes attached material attached to the outer circumference surface, and which cleans the outer circumference surface, and a detecting mechanism that is attached on an end surface on the other end side of the cleaner and that detects vibration of the cleaner. Based on the result detected by the detecting mechanism, the cleaner is replaced.

SUMMARY

Such cleaning defects occur when an orientation of contact of the plate shaped cleaner changes in a state that the wear of the plate shaped cleaner is progressing. This is due to toner leaking in a wedge space caused by a tip of the worn surface of the plate shaped cleaner rising up. Such cleaning defect is referred to as edge lifting.

Edge lifting tends to occur when a printing mode (black and white mode/full color mode) is switched. The reason is as follows. The plate shaped cleaner is in contact with the intermediate transfer belt in a position displaced so as not to directly face opposing rollers in order to avoid leaking due to foreign matter attached to the opposing roller. Due to the change in the tension of the belt when the printing mode is switched, the contact orientation of the plate shaped cleaner changes.

FIG. 11A shows an example of the contact orientation of the plate shaped cleaner 101 when the printing mode is switched from the black and white mode to the full color mode. In the example shown in FIG. 11A, the intermediate transfer belt T is used only in the black and white mode in which the tension of the belt is lower than the full color mode. Therefore, the wear in the plate shaped cleaner 101 progresses in this contact orientation. If the printing mode is switched to the full color mode right after the above, due to the belt tension rising, a belt surface position b in a state in which the plate shaped cleaner 101 is in contact with the intermediate transfer belt T in the black and white mode changes to a belt surface position a in a state in which the plate shaped cleaner 101 is in contact with the intermediate transfer belt T in the full color mode.

As a result, the contact orientation of the worn plate shaped cleaner 101 changes so that an effective contact angle becomes small and the wedge space is formed in the tip of the worn surface. With this, the toner leaks in the wedge space.

FIG. 11B shows an example of the contact orientation of the plate shaped cleaner 101 when the printing mode is switched from the full color mode to the black and white mode. In the example shown in FIG. 11B, the intermediate transfer belt T is used only in the full color mode in which the tension of the belt is higher than the black and white mode. Therefore, the wear in the plate shaped cleaner 101 progresses in this contact orientation. If the printing mode is switched to the black and white mode right after the above, due to the belt tension decreasing, the belt surface position a in the state in which the plate shaped cleaner 101 is in contact with the intermediate transfer belt T in the full color mode changes to the belt surface position b in the state in which the plate shaped cleaner 101 is in contact with the intermediate transfer belt T in the black and white mode.

As a result, the contact orientation of the worn plate shaped cleaner 101 changes so that the effective contact angle becomes large, the tip of the worn surface becomes the new edge, and the wedge space is not formed in the tip of the worn surface. With this, the toner does not leak in to the wedge space.

In order to prevent edge lifting, the plate shaped cleaner needs to be replaced at a suitable timing. The replacement timing of the plate shaped cleaner is set to a wear width when the plate shaped cleaner is mostly used in the black and white mode so as to surely prevent leaking of toner from occurring due to edge lifting under excessive conditions as shown in FIG. 11A. However, it is rare that the user prints almost all of the jobs in the black and white mode, and the quality is excessive.

FIG. 12 shows an example of the plate shaped cleaner 101 when a ratio of the printing mode at the timing of replacement of the plate shaped cleaner 101 is 50% in black and white mode and 50% in full color mode.

When the ratio of the printing mode is 50% in black and white mode and 50% in full color mode, as shown in FIG. 12, wear occurs in two surfaces. The replacement timing of the plate shaped cleaner 101 is determined by a total wear width adding the wear widths of the two surfaces. However, the wear surface in the black and white mode does not reach the wear width at the level that leaking of toner due to edge lifting occurs. Therefore, the plate shaped cleaner 101 is replaced even though the leaking of the toner due to edge lifting does not occur. Therefore, for the average user who uses the apparatus with the ratio of the printing mode being 50% in black and white mode and 50% in full color mode, the frequency of replacing the plate shaped cleaner increases to be a frequency more than necessary, and this causes increase in costs.

In order to avoid the replacement of the plate shaped cleaner being excessive quality, JP 2019-128426 and JP 2016-57492 propose a configuration which detects the state of use of the plate shaped cleaner, and the timing of replacement of the plate shaped cleaner is delayed for the user who uses the apparatus under conditions advantageous for leaking of the toner due to edge lifting. However, in both disclosures, a large scale detector is necessary. This leads to the apparatus becoming larger and more complicated, and the costs cannot be reduced.

The present invention is conceived in view of the above problems, and the purpose of the present invention is to provide a cleaning apparatus, an image forming apparatus, and a storage medium in which it is possible to replace the plate shaped cleaner at a suitable timing by using a simple method.

To achieve at least one of the above mentioned objects, according to an aspect of the present invention, a cleaning apparatus reflecting one aspect of the present invention includes: a plate shaped cleaner that comes into contact with a belt shaped member that rotates supported by a roller in a position not opposed to the roller in a surface on an opposite side of a surface where the roller comes into contact with the belt shaped member, wherein the plate shaped cleaner cleans the surface of the belt shaped member, and a hardware processor, wherein the hardware processor obtains an amount of use of the plate shaped cleaner for each belt tension state in the belt shaped member in which the belt tension state is switched, and wherein the hardware processor sets a replacement determination timing of the plate shaped cleaner based on the obtained amount of use of the plate shaped cleaner.

According to another aspect, an image forming apparatus comprising: an image former that forms an image on a sheet, wherein the image former includes, a belt shaped member in which a toner image is formed on a surface, a transferer that transfers the toner image formed on the surface of the belt shaped member onto the sheet, and a cleaning apparatus according to claim 1 that removes residual matter remaining on the surface of the belt shaped member after transferring by the transferer.

According to another aspect, a non-transitory computer-readable storage medium storing a program causing a computer in a cleaning apparatus to perform the following, the cleaning apparatus including a plate shaped cleaner that comes into contact with a belt shaped member that rotates supported by a roller in a position not opposed to the roller in a surface on an opposite side of a surface where the roller comes into contact with the belt shaped member, wherein the plate shaped cleaner cleans the surface of the belt shaped member, wherein the program causes the computer to perform, obtaining an amount of use of the plate shaped cleaner for each belt tension state in the belt shaped member in which the belt tension state is switched, and setting a replacement determination timing of the plate shaped cleaner based on the obtained amount of use of the plate shaped cleaner.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein:

FIG. 4A is a diagram showing an example evaluating cleaning properties when changed from a first state to a second state;

FIG. 4B is a diagram showing an example evaluating cleaning properties remaining in the second state;

DETAILED DESCRIPTION OF THE EMBODIMENTS

Hereinafter, one or more embodiments of the present invention will be described in detail with reference to the drawings. However, the scope of the invention is not limited to the disclosed embodiments.

The image forming apparatus 1 according to the present embodiment is a color image forming apparatus that performs operation by an intermediate transfer method that uses an electro-photographic processing technique. As printing modes, a black and white mode or a full color mode can be set.

Figure 1:
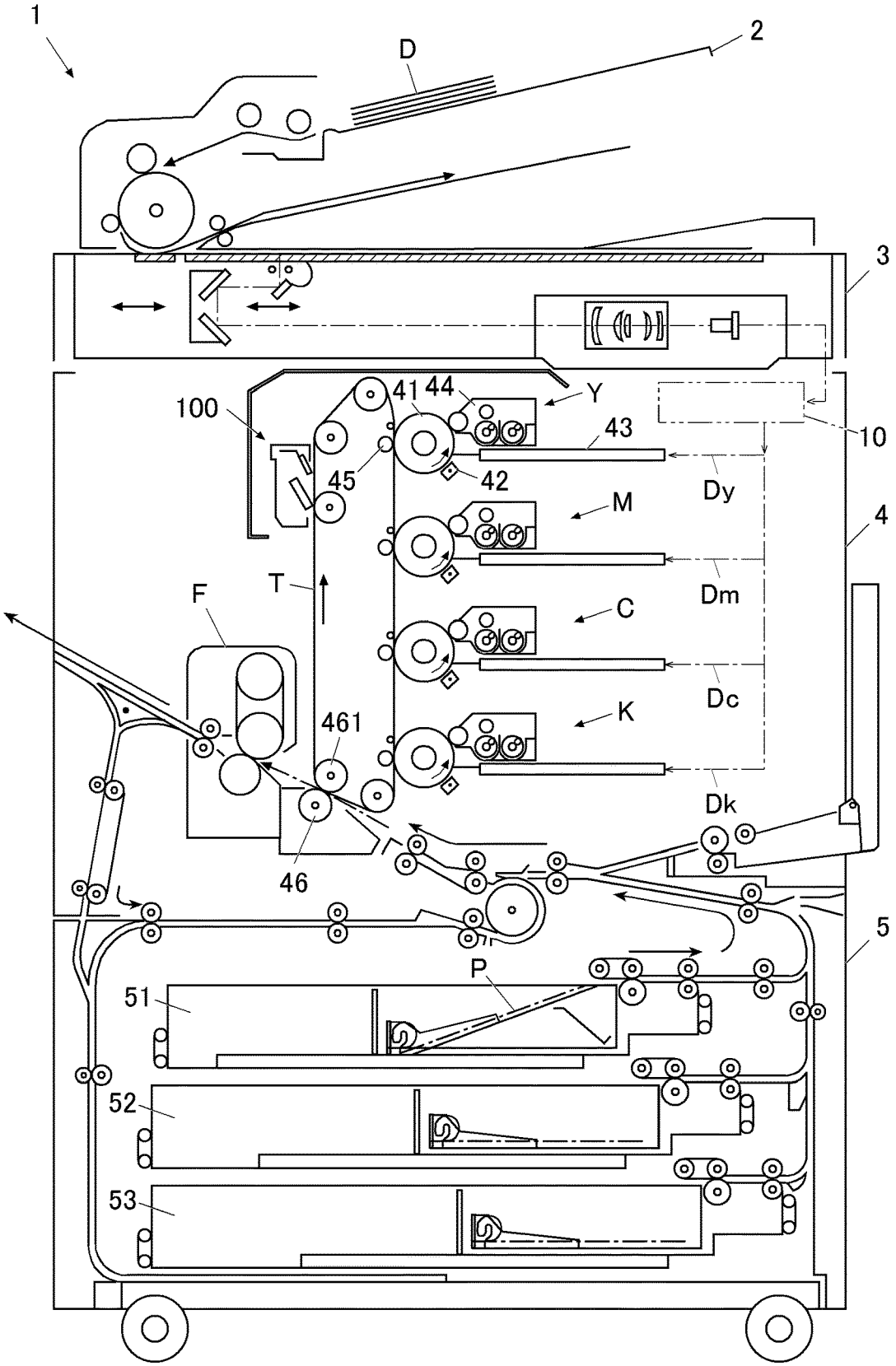
FIG. 1 is a diagram showing a schematic configuration of an image forming apparatus according to the present embodiment.
Figure 2:
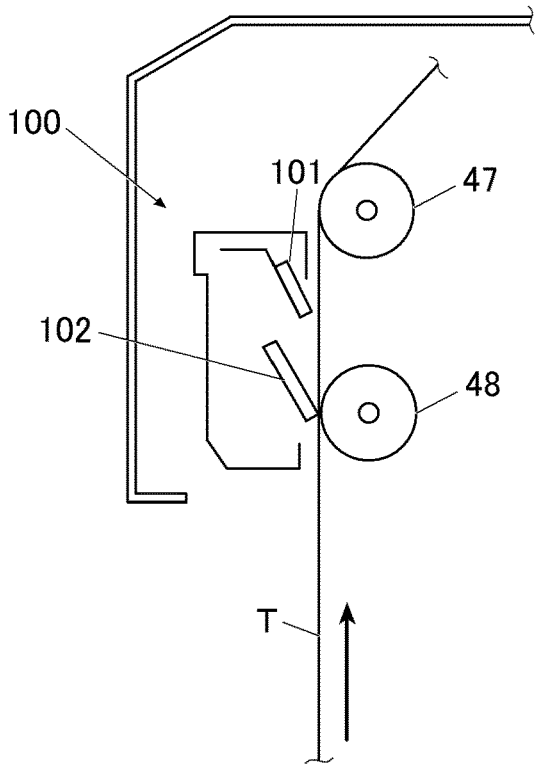
FIG. 2 is a diagram showing a schematic configuration of a cleaner.
Figure 3:
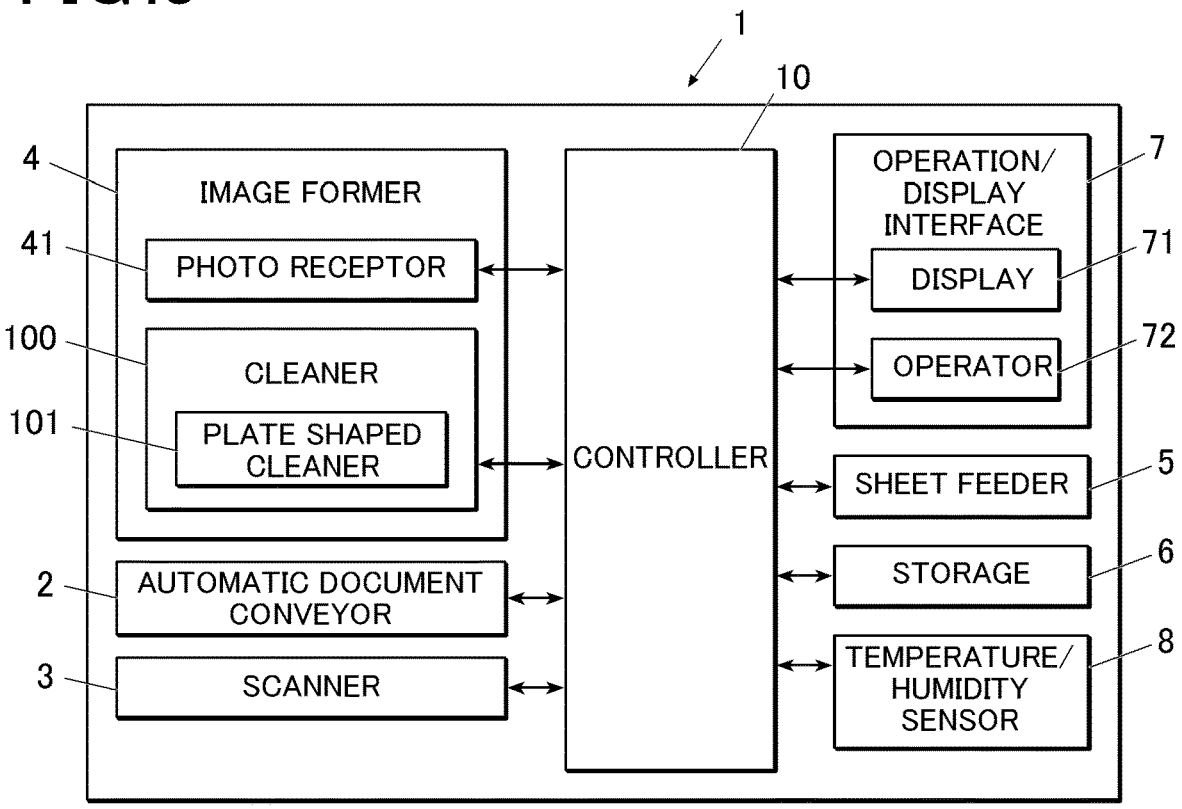
FIG. 3 is a functional block diagram showing a control configuration of the image forming apparatus according to the present embodiment.

As shown in FIG. 1 to FIG. 3, the image forming apparatus 1 includes an automatic document conveyor 2, a scanner 3, an image former 4, a sheet feeder 5, a storage 6, an operation/display interface 7, a temperature/humidity sensor 8, and a controller 10.

FIG. 1 is a diagram showing a schematic configuration of an image forming apparatus 1.

The automatic document conveyor 2 includes a placement tray on which a document D is placed, a mechanism and conveying roller that convey the document D, and the like. The automatic document conveyor 2 conveys the document D on a predetermined conveying path.

The scanner 3 includes an optical system such as an optical source, a reflecting mirror, and the like. The scanner 3 emits light from the optical source to the document D conveyed on the predetermined conveying path or the document D placed on a platen glass and receives the reflected light. The scanner 3 converts the received reflected light to an electric signal, and outputs the electric signal to the controller 10.

The image former 4 includes a yellow imager Y, a magenta imager M, a cyan imager C, a black imager K, an intermediate transfer belt (belt shaped member) T. and a fixing device F.

Each imager YMCK forms a toner image in yellow, magenta, cyan, or black, respectively, on a photoreceptor 41, and the toner images in the colors YMCK formed on the photoreceptor 41 are transferred by primary transfer on the intermediate transfer belt T. As shown in FIG. 1 and FIG. 2, each imager YMCK includes the photoreceptor 41, a charging device 42, an exposure device 43, a developing device 44, a primary transfer roller 45, a secondary transfer roller 46, and a cleaner 100. The configuration and operation of each imager YMCK are all the same. Therefore, hereinbelow, the flow of the image forming operation performed by the image former 4 is described with reference to the yellow imager Y as the example.

The photoreceptor 41 includes an organic photoreceptor in which a photosensitive layer is formed on an outer circumference surface of a drum-shaped metal base. The photosensitive layer includes resin including an organic photoconductor. The photoreceptor 41 is driven to rotate. Resin that is included in the photosensitive layer may be polycarbonate resin, silicone resin, polystyrene resin, acrylic resin, methacrylic resin, epoxy resin, polyurethane resin, vinyl chloride resin, and melamine resin, for example.

The charging device 42 uses a charger to charge the photoreceptor 41 to a certain potential.

The exposure device 43 exposes a non-image region of the photoreceptor 41 based on image data Dy from the controller 10 to remove charge of the exposed portion, and forms the electrostatic latent image in the image region of the photoreceptor 41.

The developing device 44 supplies toner which is a developing agent on the electrostatic latent image formed on the photoreceptor 41, and a yellow toner image is formed on the photoreceptor 41.

Primary transfer is performed by the primary transfer roller 45 to transfer the yellow toner image formed on the photoreceptor 41 onto the intermediate transfer belt T. Similarly, primary transfer is performed in the other imagers MCK to transfer the toner images in magenta, cyan, and black onto the intermediate transfer belt T. With this, the toner images in the colors YMCK are formed on the intermediate transfer belt T.

The intermediate transfer belt T is a semi-conductive endless belt hung around a plurality of rollers to be supported in a rotatable state. The intermediate transfer belt T is driven to be rotated with the rotation of the rollers. The intermediate transfer belt T is pressed against each photoreceptor 41 by the opposing primary transfer roller 45. A transfer electric current according to the applied voltage flows in each primary transfer roller 45. With this, primary transfer is performed and each toner image developed on the surface of each photoreceptor 41 is sequentially transferred on the intermediate transfer belt T by each primary transfer roller 45.

Figure 11A:
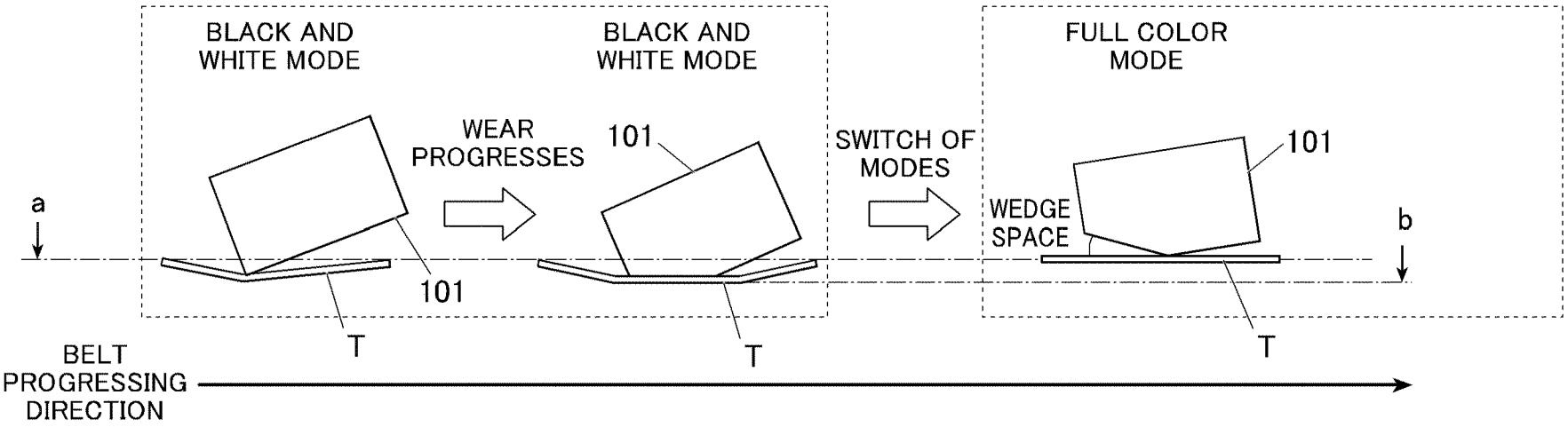
FIG. 11A is a diagram showing an example of a contact orientation of the plate shaped member when switching from a black and white mode to a full color mode.
Figure 11B:
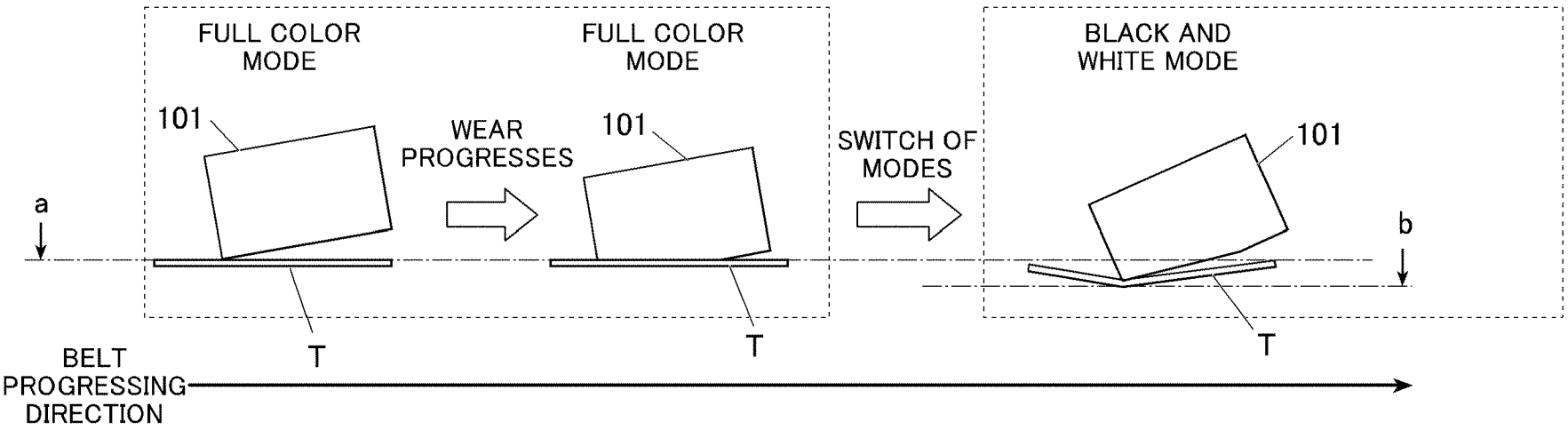
FIG. 11B is a diagram showing an example of a contact orientation of the plate shaped member when switching from the full color mode to the black and white mode.
Figure 12:
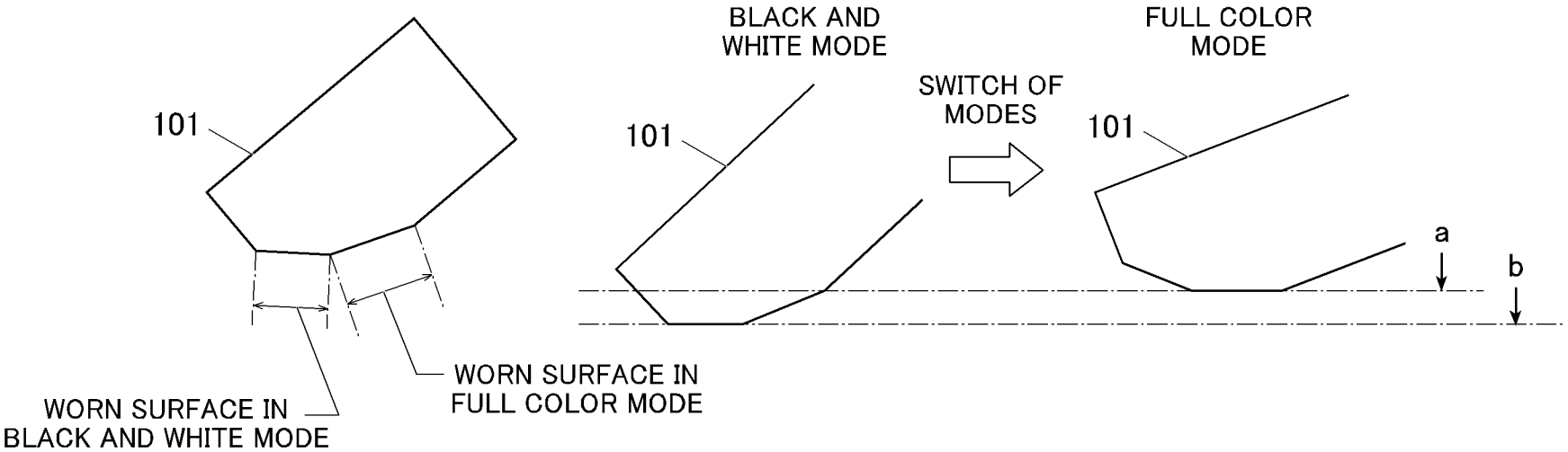
FIG. 12 is a diagram showing an example of the plate shaped cleaner when the ratio of the printing mode at the timing of replacing the plate shaped cleaner is 50% in black and white mode and 50% in full color mode.

The belt tension state of the intermediate transfer belt T changes depending on the printing mode. Specifically, as shown in FIG. 11A, the belt tension in the black and white mode is lower than the full color mode. This is because, when the printing mode is switched, the number of primary transfer rollers 45 that press against the intermediate transfer belt T changes, and with this, the belt tension state of the intermediate transfer belt T switches.

The secondary transfer (transfer unit) 46 is pressed against the intermediate transfer roller T and rotates in a manner following the intermediate transfer roller T. With this, the secondary transfer is performed and the toner images in the colors YMCK transferred and formed on the intermediate transfer belt T are transferred onto the sheet P conveyed from sheet feeding trays 51 to 53 of the sheet feeder 5. The secondary transfer roller 46 is positioned in contact with a secondary transfer opposing roller 461 with the intermediate transfer belt T in between. The sheet P passes a transfer nip formed between the secondary transfer roller 46 and the secondary transfer opposing roller 461. With this, secondary transfer is performed and the toner image on the intermediate transfer belt T is transferred on the sheet P.

The image former 4 uses the fixing device F to apply heat and pressure to the sheet P on which secondary transfer is performed to transfer the toner images in the colors YMCK. Then, the image former 4 passes the sheet P on the predetermined conveying path and ejects the sheet P outside the apparatus.

The above is the flow of the image forming operation performed by the image former 4.

FIG. 2 shows a schematic configuration of the cleaner 100.

In the cleaner 100, the tips of the cleaning blade 102 and the plate shaped cleaner 101 are placed to be in counter method contact with the intermediate transfer belt T after the toner image is transferred onto the sheet P by the secondary transfer roller 46. Residual matter such as residual toner and paper dust that remain without being transferred onto the sheet P is removed from the intermediate transfer belt T, and the intermediate transfer belt T is cleaned.

The cleaning blade 102 comes into contact with the surface in which the toner image is formed on the intermediate transfer belt T, and removes the residual matter such as residual toner, paper dust, external additives and the like remaining on the intermediate transfer belt T after the secondary transfer. With this, the intermediate transfer belt T is cleaned.

As shown in FIG. 2, the cleaning blade 102 comes into contact with the surface in which the toner image is formed on the intermediate transfer belt T in the position opposed to the roller 48 which supports the intermediate transfer belt T.

The material and the condition of contact (contact pressure/contact angle) of the cleaning blade 102 are not limited if predetermined cleaning properties can be secured for the amount of toner that flows in. As the material of the cleaning blade 102, for example, urethane rubber is used.

The plate shaped cleaner 101 comes into contact with the surface in which the toner image is formed on the intermediate transfer belt T on the downstream side than the cleaning blade 102 in the conveying direction of the intermediate transfer belt T, and removes the residual matter such as residual toner, paper dust, external additives and the like that could not be removed completely by the cleaning blade 102 and that remain on the intermediate transfer belt T after secondary transfer. With this, the intermediate transfer belt T is cleaned.

As shown in FIG. 2, the plate shaped cleaner 101 comes into contact with the surface in which the toner image is formed on the intermediate transfer belt T in the position not facing the roller 47 which supports the intermediate transfer belt T.

The material and the condition of contact (contact pressure/contact angle) of the plate shaped cleaner 101 are not limited if predetermined cleaning properties can be secured for the amount of toner that flows in.

The higher the stiffness of the material included in the plate shaped cleaner 101 is, the more likely it is that the toner will leak due to edge lifting. If the material is soft such as a rubber blade, even if the contact orientation of the plate shaped cleaner 101 changes, the shape of the tip changes and it is difficult for the wedge space to be formed. Therefore, even if the wear progresses, the occasions that the leak of the toner due to edge lifting occurs is small. On the other hand, the shape of the tip in a metal scraper does not change. Therefore, the leak of the toner due to edge lifting easily occurs even with the same degree of wear width as the rubber blade. Therefore, it is preferable to apply the present invention to metal scrapers.

The sheet feeder 5 includes a plurality of sheet feeding trays 51 to 53, and a plurality of sheets P are stored in each sheet feeding tray 51 to 53, the type of sheet being different for each sheet feeding tray. The sheet feeder 5 feeds the stored sheet P through the predetermined conveying path to the image former 4.

FIG. 3 is a functional block diagram showing a control configuration of the image forming apparatus 1.

The storage 6 includes a HDD (Hard Disk Drive), a semiconductor memory, and the like, and is able to store in a readable and writable format data such as program data and various setting data under the control by the controller 10.

Regarding the replacement timing of the plate shaped cleaner 101, the storage 6 stores a later described first replacement timing and a second replacement timing.

The storage 6 stores the replacement determination timing of the plate shaped cleaner 101.

The storage 6 stores an amount of use of the plate shaped cleaner 101 for each belt tension state. The amount of use of the plate shaped cleaner 101 is the number of sheets printed by the image forming apparatus 1 and the distance that the plate shaped cleaner 101 rubs against the intermediate transfer belt T, for example. The storage 6 stores the entire amount of use adding the amount of use of the plate shaped cleaner 101 for each belt tension state.

For example, the operation/display interface 7 includes a liquid crystal display (LCD) with a touch panel, and includes a display 71 and an operator 72.

The display 71 displays various operation screens and the operation status of the various functions according to display control signals input from the controller 10. The display 71 also receives touch operation by the user and outputs operation signals to the controller 10.

The operator 72 includes various operation keys such as numeric keys and a start key. The operator 72 receives operation of various input by the user and outputs the operation signals to the controller 10. The user operates the operation/display interface 7, and is able to perform various setting regarding the image forming such as image quality setting, magnification setting, advanced setting, output setting, and sheet setting. The user is also able to instruct conveying of the sheet and to stop the operation of the apparatus.

The temperature/humidity sensor 8 detects temperature information and humidity information near the intermediate transfer belt T and outputs the information to the controller 10.

The controller 10 includes a CPU, a RAM, and a ROM. The CPU deploys various programs stored in the ROM to the RAM, and in coordination with the various deployed programs, the controller 10 centrally controls the operation of various units in the image forming apparatus 1 such as the automatic document conveyor 2, the scanner 3, the image former 4, the sheet feeder 5, the storage 6, the operation/display interface 7, and the temperature/humidity sensor 8. For example, the electric signals are input from the scanner 3 and the controller 10 performs various image processes. The controller 10 outputs the image data Dy, Dm, Dc, Dk in the colors YMCK generated by image processes to the image former 4. The controller 10 controls the operation of the image former 4 and forms the image on the sheet P.

The belt tension state of a belt shaped member (intermediate transfer belt T) switches. The controller 10 obtains the amount of use of the plate shaped cleaner 101 for each belt tension state that a belt shaped member is in. Here, the controller 10 functions as a first obtainer.

The controller 10 sets a replacement determination timing of the plate shaped cleaner 101 based on the amount of use of the plate shaped member 101 obtained by the first obtainer. Here, the controller 10 functions as a setter.

Based on the amount of use of the plate shaped cleaner 101 obtained by the first obtainer, the controller 10 calculates a use rate which is a ratio of the actual amount of use with relation to a maximum amount of use of the plate shaped cleaner 101 set in advance for each belt tension state. Here, the controller 10 functions as a calculator.

When it is the replacement determination timing set by the setter, the controller 10 determines whether it is the replacement timing. Here, the controller 10 functions as a determiner.

When the determiner determines that it is the replacement timing, the controller 10 notifies the above to the user. Here, the controller 10 functions as a notifier.

The controller 10, the storage 6, and the cleaner 100 function as the cleaning apparatus 1000.

Here, the first replacement timing and the second replacement timing which are the replacement timing of the plate shaped cleaner 101 are described.

The first replacement timing is the replacement timing in which the use limit of the plate shaped cleaner 101 is the shortest. Regarding the predetermined amount of use of the plate shaped cleaner 101, a percentage that the intermediate transfer belt T is used with the belt tension state in the first state is 100%. The first state is, for example, the black and white mode.

The second replacement timing is the replacement timing in which the use limit of the plate shaped cleaner 101 is the longest. Regarding the predetermined amount of use of the plate shaped cleaner 101, a percentage that the intermediate transfer belt T is used with the belt tension state in the second state is 100%. The second state is, for example, a full color mode.

Next, the method to set the first replacement timing and the second replacement timing is described.

The first replacement timing and the second replacement timing are set by evaluating a cleaning performance with relation to a predetermined amount of use of the plate shaped cleaner 101.

For example, the method of evaluation is performed by conveying a solid image which is not transferred to a cleaner and evaluating how much leakage of toner occurs. The method of evaluation is not limited to the above.

FIG. 4A is a diagram showing an example in which the cleaning properties are evaluated when the amount of use of the plate shaped cleaner 101 reaches a predetermined amount with the belt tension state of the intermediate transfer belt T in the first state and then the belt tension state is changed to the second state. According to the example shown in FIG. 4A, the cleaning properties are maintained when the amount of use of the plate shaped cleaner 101 is equal to or less than 400 kp (number of printed sheets). Here, the first replacement timing is set to when the percentage of use of the plate shaped cleaner 101 is 100% in the first state when the amount of use of the plate shaped cleaner 101 is 400 kp. Further, the maximum amount of use in the first state is set to 400 kp.

FIG. 4B is a diagram showing an example in which the cleaning properties are evaluated when the amount of use of the plate shaped cleaner 101 reaches a predetermined amount with the belt tension state of the intermediate transfer belt T in the second state and the belt tension state is maintained in the second state. According to the example shown in FIG. 4B, the cleaning properties are maintained when the amount of use of the plate shaped cleaner 101 is equal to or less than 900 kp. Here, the second replacement timing is set to when the amount of use of the plate shaped cleaner 101 is 900 kp. The maximum amount of use in the second state is 900 kp.

Next, the operation of the present embodiment is described.

Figure 5:
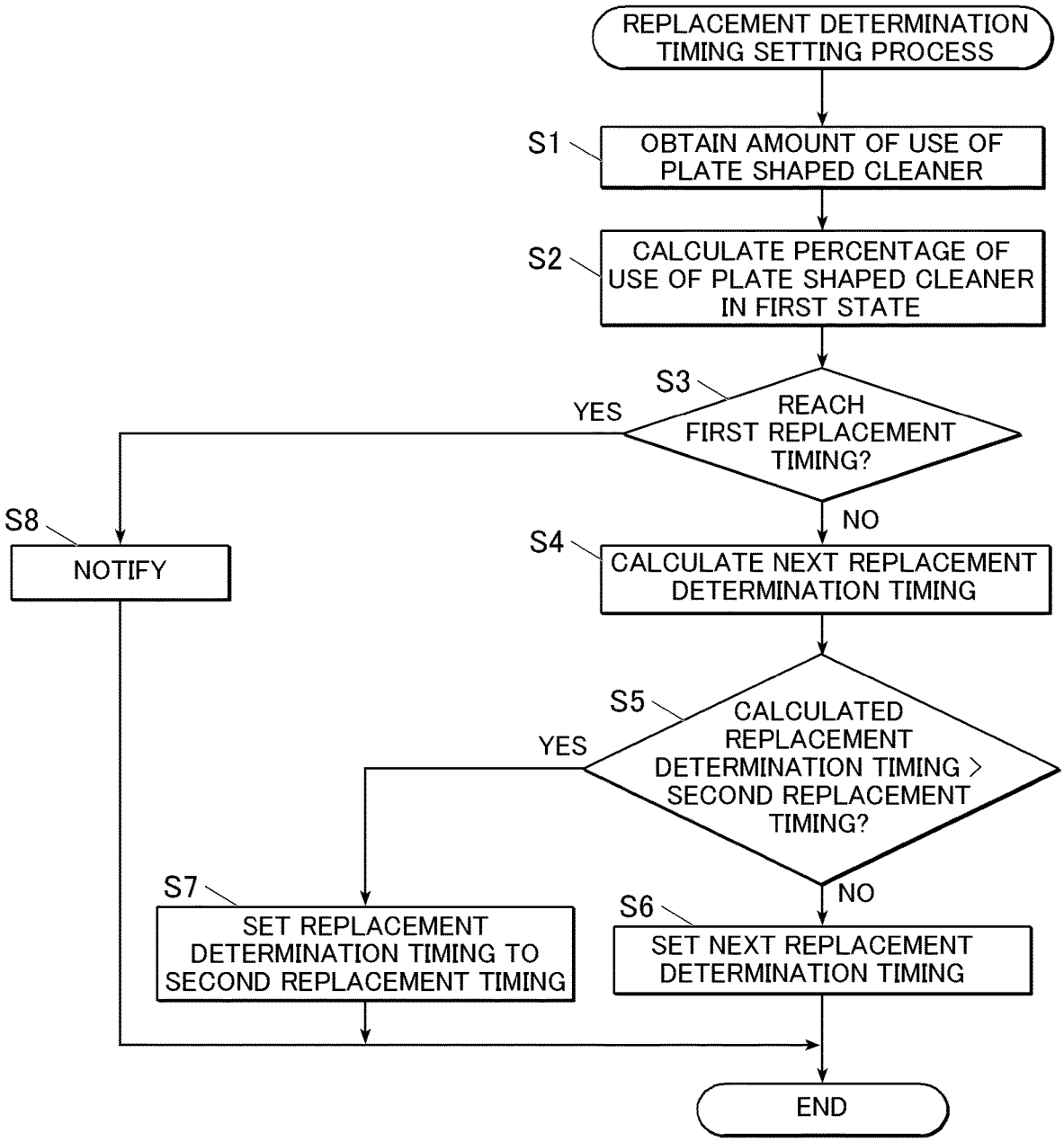
FIG. 5 is a flowchart showing a replacement determination timing setting process.

FIG. 5 is a flowchart showing a replacement determination timing setting process in which the replacement determination timing is set. The replacement determination timing is the timing that it is determined whether or not the plate shaped cleaner 101 reached the replacement timing. The replacement determination timing setting process is performed in coordination with the program stored in the controller 10 and the storage 6. The replacement determination timing setting process is first performed when the entire amount of use of the plate shaped cleaner 101 reaches the maximum amount of use in the first state. According to the example shown in FIG. 4A, the maximum amount of use in the first state is 400 kp.

In the replacement determination timing setting process, the controller 10 obtains the amount of use of the plate shaped cleaner 101 for each belt tension state of the intermediate transfer belt T (step S1). Specifically, the controller 10 obtains the number of printed sheets that the image forming apparatus 1 printed in each printing mode from the storage 6 or the distance that the plate shaped cleaner 101 rubs against the intermediate transfer belt T. By using the printing mode setting information as the belt tension state information, there is no need for a new sensor or a new mechanism in order to obtain the belt tension state information, and the configuration can be simplified.

Next, the controller 10 calculates the percentage of use of the plate shaped cleaner 101 in the first state (step S2). Specifically, the controller 10 calculates the percentage of use which is the ratio of the actual amount of use with relation to the maximum amount of use of the plate shaped cleaner 101 in the first state from the amount of use of the plate shaped member 101 obtained in step S1.

Figure 6:
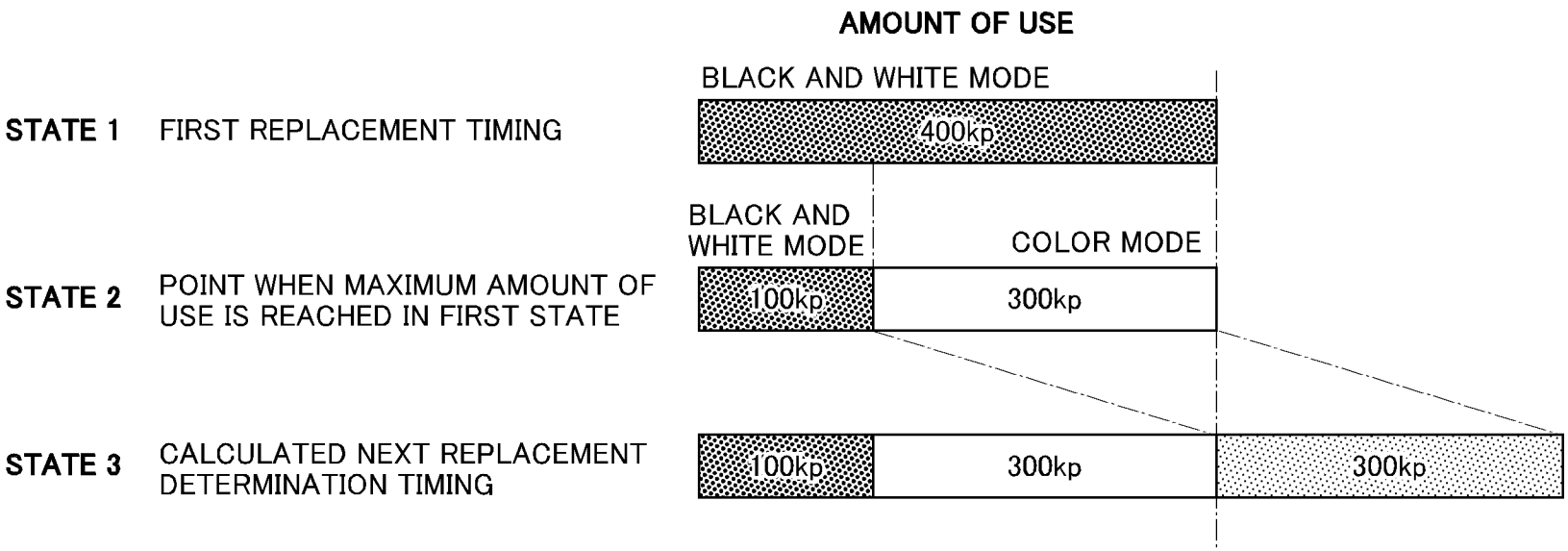
FIG. 6 is a diagram showing an example of setting a replacement determination timing.

According to the example shown in the state 2 in FIG. 6, the amount of use in the black and white mode is 100 kp, and therefore, the percentage of use in the black and white mode with relation to 400 kp which is the maximum amount of use in the first state is 25%.

Next, the controller 10 determines whether the plate shaped cleaner 101 reached the first replacement timing (step S3). That is, the controller 10 determines whether the percentage of use of the plate shaped cleaner 101 in the first state (black and white mode) with relation to the maximum amount of use in the first state calculated in step S2 reached 100%.

When the plate shaped cleaner 101 is not at the first replacement timing (step S3; NO), this is, in other words, as shown in state 2 in FIG. 6, when the amount of use in the black and white mode is 100 kp, the percentage of use in the black and white mode with relation to 400 kp which is the maximum amount of use in the first state is 25%, and the percentage of use is not 100% with relation to the maximum amount of use (400 kp) in the first state. In this case, the controller 10 calculates the next replacement determination timing (step S4). In the example shown in state 2 in FIG. 6, the amount of use that can be further used until reaching the first replacement timing is the amount of use being 300 kp in the black and white mode. In this case, 300 kp which is the amount of use that can be further used is added to the entire amount of use 400 kp in the state 2 in FIG. 6, and the next replacement determination timing is calculated to be 700 kp as shown in state 3 in FIG. 6. That is, the timing that the percentage of use of the plate shaped cleaner 101 becomes 100% after the replacement determination timing setting process when the apparatus is used in only the first state, that is, the shortest timing that the percentage of use of the plate shaped cleaner 101 becomes 100% after the replacement determination timing setting process when the apparatus is used in the first state is calculated as the next replacement determination timing of the plate shaped cleaner 101.

Next, the controller 10 determines whether the next replacement determination timing calculated in step S4 is larger than the second replacement timing (step S5).

When the calculated next replacement determination timing is not larger than the second replacement timing (step S5; NO), the controller 10 sets the replacement determination timing calculated in step S4 as the next replacement determination timing of the plate shaped cleaner 101 (step S6), and ends the process. This is an example in which the calculated next replacement determination timing is 700 kp as shown in the state 3 in FIG. 6, and the second replacement timing is 900 kp as shown in FIG. 4B.

When the calculated next replacement determination timing is larger than the second replacement timing (step S5: YES), the controller 10 sets the replacement determination timing to be the second replacement timing (step S7), and ends the process.

After the replacement determination timing is set to the second replacement timing, when the entire amount of use of the plate shaped cleaner 101 reaches the second replacement timing, the controller 10 displays on the display 71 a message that it is the replacement timing in order to notify the replacement timing to the user.

When the plate shaped cleaner 101 reaches the first replacement timing (step S3; YES), this is when the percentage of use in the black and white mode is 100% with relation to the maximum amount of use (400 kp) in the first state. In the above case, the controller 10 displays on the display 71 the message that it is the replacement timing in order to notify the replacement timing to the user (step S8).

Figure 7:
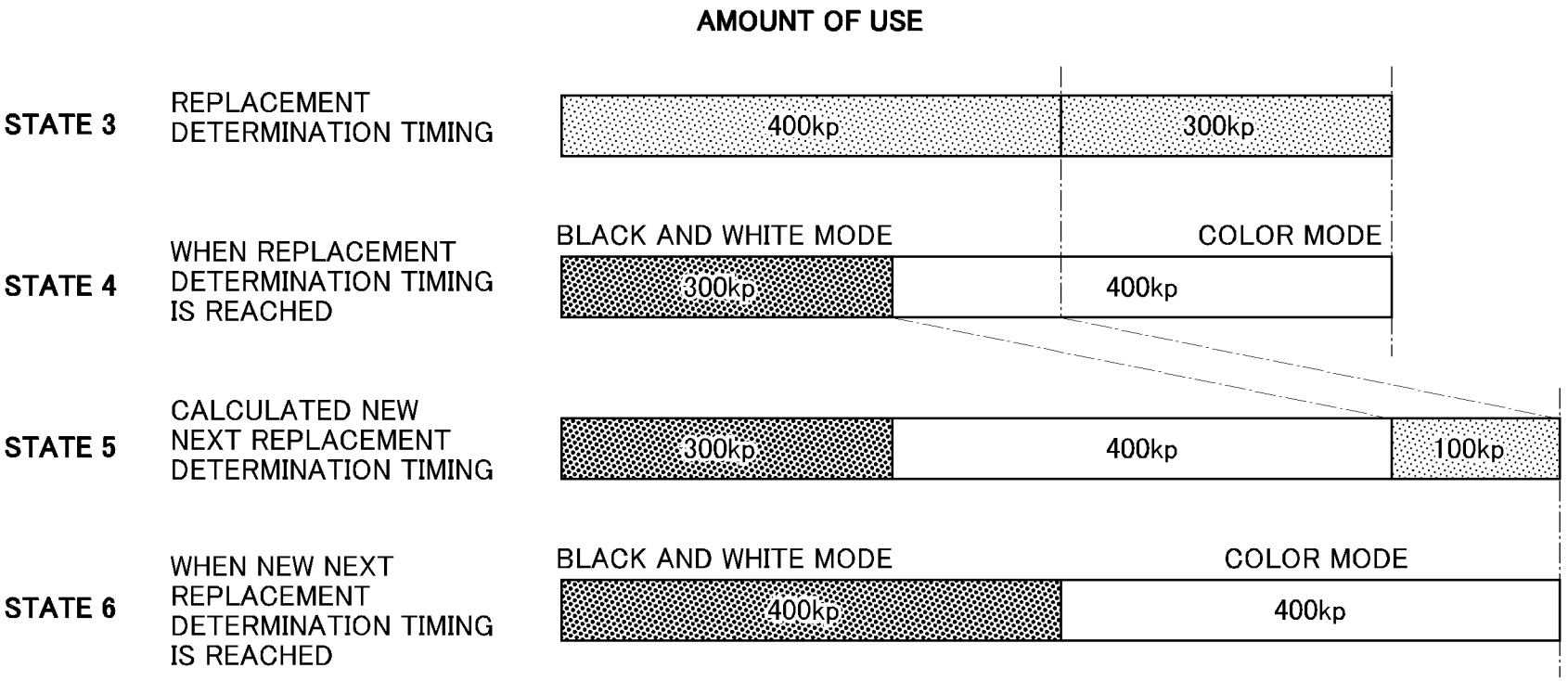
FIG. 7 is a diagram showing an example of resetting the replacement determination timing.

The example described below is when it becomes the set replacement determination timing after the replacement determination timing setting process shown in FIG. 5. The example shown in the state 3 in FIG. 7 shows when the replacement determination timing is when the entire amount of use of the plate shaped cleaner 101 is 700 kp. When it is the set replacement determination timing, the controller 10 performs the steps S1 and S2 in the replacement determination timing setting process shown in FIG. 5 again.

Next, the controller 10 determines whether the plate shaped cleaner 101 reached the first replacement timing (step S3).

When the plate shaped cleaner 101 is not at the first replacement timing (step S3; NO) this is, in other words, as shown in state 4 in FIG. 7, when the amount of use in the black and white mode is 300 kp, the percentage of use in the black and white mode with relation to 400 kp which is the maximum amount of use in the first state is 75%, and the percentage of use is not 100% with relation to the maximum amount of use (400 kp) in the first state. In this case, the controller 10 calculates the new next replacement determination timing (step S4). In the example shown in state 4 in FIG. 7, the amount of use that can be further used until reaching the first replacement timing is the amount of use being 100 kp in the black and white mode. In this case, 100 kp which is the amount of use that can be further used is added to the entire amount of use 700 kp in the state 4 in FIG. 7, and the next replacement determination timing is calculated to be 800 kp as shown in state 5 in FIG. 7. That is, the timing that the percentage of use of the plate shaped cleaner 101 becomes 100% after the replacement determination timing setting process when the apparatus is used in only the first state, that is, the shortest timing that the percentage of use of the plate shaped cleaner 101 becomes 100% after the replacement determination timing setting process when the apparatus is used in the first state is calculated as the new next replacement determination timing of the plate shaped cleaner 101.

Next, the processes in steps S5 to S7 similar to the above are performed at the new next replacement determination timing calculated in step S4, and the controller 10 ends the process.

The example when it is the new next replacement determination timing and it is the first replacement timing is shown in state 6 in FIG. 7. In the state 6 in FIG. 7, the entire amount of use is 800 kp which is the new next replacement determination timing. Further, the amount of use in the black and white mode is 400 kp, and the percentage of use in the black and white mode is 100% with relation to the maximum amount of use (400 kp) in the first state. In this case, the notification in step S8 is performed.

Figure 8:
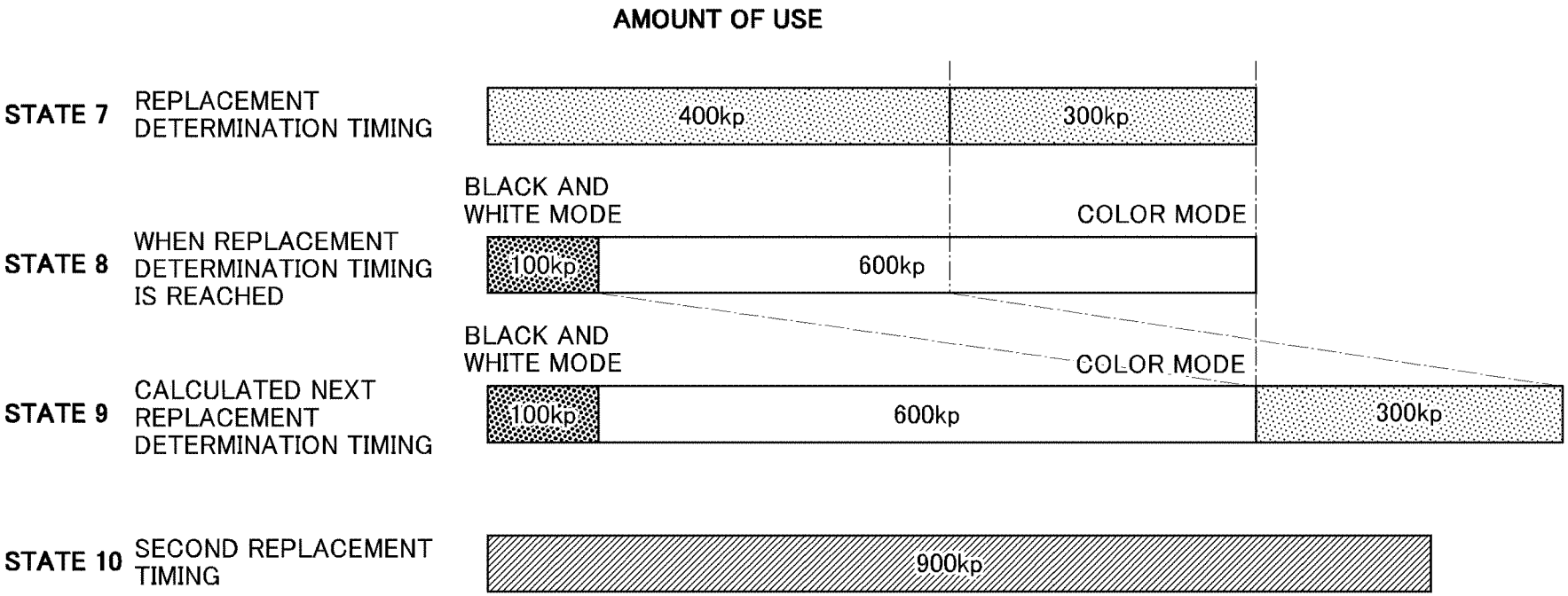
FIG. 8 is a diagram showing an example of setting the replacement determination timing.

The example in which the next replacement determination timing calculated in step S4 is larger than the second replacement timing is shown in FIG. 8. In the example shown in FIG. 8, the replacement determination timing is when the entire amount of use is 700 kp as shown in state 7. State 8 in FIG. 8 shows the amount of use for each belt tension state (printing mode) when it is the replacement determination timing. According to the example shown in the state 8 in FIG. 8, the amount of use in the black and white mode is 100 kp, and the percentage of use in the black and white mode is 25% with relation to 400 kp which is the maximum amount of use in the first state. The percentage of use is not 100% with the maximum amount of use (400 kp) in the first state. In this case, the controller 10 calculates the next replacement determination timing. In the example shown in the state 8 in FIG. 8, the amount of use that can be further used until reaching the first replacement timing is the amount of use being 300 kp in the black and white mode. In this case, 300 kp which is the amount of use that can be further used is added to the entire amount of use 700 kp in the state 8 in FIG. 8, and the next replacement determination timing is calculated to be 1000 kp as shown in state 9 in FIG. 8. However, 1000 kp which is the calculated next replacement determination timing is larger than 900 kp which is the second replacement timing shown in the state 10 in FIG. 8. Therefore, the controller 10 sets the replacement determination timing to be 900 kp which is the second replacement timing.

(Modification)

The differences from the above embodiments are mainly described below. The configuration of the image forming apparatus 1 and the cleaning apparatus 1000 in the modification is the same as the configuration of the image forming apparatus 1 and the cleaning apparatus 1000 according to the above embodiment.

Figures 9, 10:
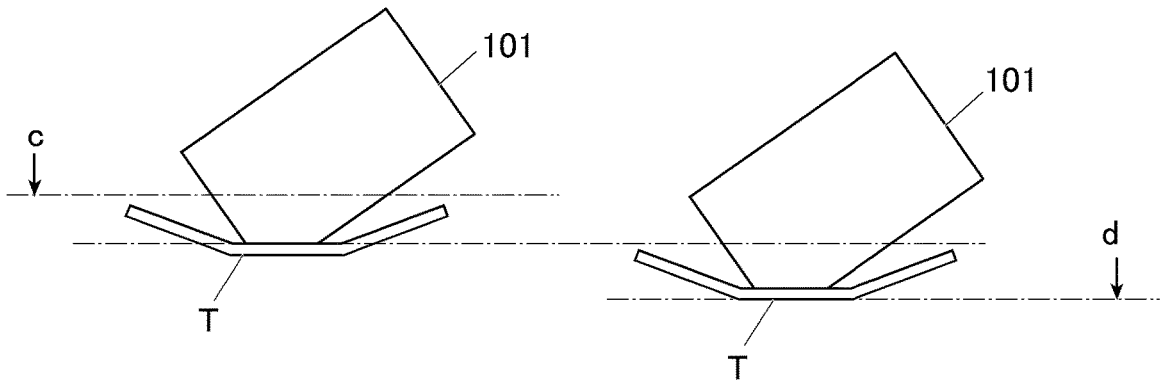
FIG. 9 is a diagram showing an example in which belt tension decreases due to temperature/humidity and amount of use of the intermediate transfer belt.
FIG. 10 shows an example of a setting coefficient of a first replacement timing corresponding to the humidity and the amount of use of the intermediate transfer belt.

FIG. 9 is a diagram showing the belt tension decreased by the temperature, humidity and the amount of use of the intermediate transfer belt T.

The right of FIG. 9 shows when the temperature and humidity near the intermediate transfer belt T are higher than the predetermined value, and the amount of use of the intermediate transfer belt T is larger than the predetermined value. In this case, the intermediate transfer belt T may stretch and the belt tension may be decreased. In FIG. 9, the position of the belt surface in which the plate shaped cleaner 101 is not in contact with the intermediate transfer belt T is to be c. The position of the belt surface where the intermediate transfer belt T is stretched is to be d. In the example shown in the right of FIG. 9, the maximum amount of use at the first replacement timing is small. Therefore, a more suitable first replacement timing is set based on the temperature and the humidity near the intermediate transfer belt T and the amount of use of the intermediate transfer belt T.

According to the present modification, the storage 6 stores the amount of use of the intermediate transfer belt T. The storage 6 stores the setting coefficient corresponding to the temperature and the humidity near the intermediate transfer belt T and the amount of use of the intermediate transfer belt T.

The controller 10 obtains either one of the temperature/humidity information near the intermediate transfer belt T and/or the amount of use of the belt shaped member (intermediate transfer belt T). Here, the controller 10 functions as a second obtainer.

FIG. 10 is a diagram showing an example of the setting coefficient of the first replacement timing corresponding to the absolute humidity near the intermediate transfer belt T and the amount of use of the intermediate transfer belt T.

The controller 10 sets the first replacement timing according to the temperature/humidity information near the intermediate transfer belt T and the amount of use of the intermediate transfer belt T. Specifically, the controller 10 obtains the temperature/humidity information near the intermediate transfer belt T from the temperature/humidity sensor 8. The controller 10 obtains the amount of use of the intermediate transfer belt T from the storage 6. Then, the controller 10 obtains the setting coefficient corresponding to the temperature/humidity information near the intermediate transfer belt T and the amount of use of the intermediate transfer belt T from the storage 6 and determines the suitable coefficient. Then, the controller 10 multiplies the setting coefficient to the maximum amount of use in the first state shown in FIG. 4A so as to be able to set the more suitable maximum amount of use in the first state. Then, the controller 10 sets the replacement determination timing based on the more suitable maximum amount of use in the first state.

FIG. 10 shows an example of the setting coefficient of the first replacement timing corresponding to the absolute humidity and the amount of use of the intermediate transfer belt T, but the setting coefficient of the first replacement timing may correspond to either one of the temperature/humidity information or the amount of use of the intermediate transfer belt T. In this case, the controller 10 functions as the second obtainer and obtains either one of the temperature/humidity information or the amount of use of the intermediate transfer belt T.

As described above, the cleaning apparatus 1000 of the image forming apparatus 1 according to the present embodiment includes the following. A plate shaped cleaner 101 comes into contact with a surface of a belt shaped member (intermediate transfer belt T) rotating supported by the roller 48 in a position not opposed to the roller 48 and a surface on the opposite side of the surface where the belt shaped member comes into contact with the roller 48. The plate shaped cleaner 101 cleans a surface of the belt shaped member. A first obtainer (controller 10) obtains an amount of use of the plate shaped cleaner 101 for each belt tension state in the belt shaped member in which the belt tension state is switched. A setter (controller 10) sets a replacement determination timing of the plate shaped cleaner 101 based on the amount of use of the plate shaped cleaner 101 obtained by the first obtainer.

Therefore, according to the cleaning apparatus 1000 of the present embodiment, the replacement determination timing of the plate shaped cleaner can be set suitably by an easier method. Therefore, the plate shaped cleaner can be replaced at a more suitable timing.

The cleaning apparatus 1000 according to the present embodiment includes a calculator (controller 10) that calculates a percentage of use which is a ratio of the actual amount of use with relation to the maximum amount of use of the plate shaped cleaner 101 set in advance for each belt tension state based on the amount of use of the plate shaped cleaner 101 obtained by the first obtainer. The setter sets the replacement determination timing of the plate shaped cleaner 101 based on the percentage of use of the plate shaped cleaner 101.

Therefore, according to the cleaning apparatus 1000 of the present embodiment, the plate shaped cleaner can be replaced at a more suitable timing with a simple method based on the percentage of use of the plate shaped cleaner 101.

According to the cleaning apparatus 1000 of the present embodiment, the belt tension state in which the replacement timing of the plate shaped cleaner 101 becomes the shortest is the first state and the second state is when the replacement timing becomes the longest. The setter sets the shortest timing that the percentage of use of the plate shaped cleaner 101 becomes 100% in the first state as the replacement determination timing of the plate shaped cleaner 101.

Therefore, according to the cleaning apparatus 1000 of the present embodiment, the plate shaped cleaner can be replaced at a more suitable timing with a simple method based on the percentage of use of the plate shaped cleaner 101 in the first state.

The cleaning apparatus 1000 of the present embodiment includes the determiner (controller 10) that determines whether it is the replacement timing when the replacement determination timing set by the setter is reached, and a notifier (controller 10) that notifies to the user when the determiner determines that it is the replacement timing. Therefore, according to the cleaning apparatus 1000 of the present embodiment, the user is able to replace the plate shaped cleaner at a suitable time by receiving the notification.

In the cleaning apparatus 1000 according to the present embodiment, when the replacement determination timing set by the setter is reached, the determiner determines whether the percentage of use of the plate shaped cleaner 101 reached 100% in the first state, and when the percentage of use of the plate shaped cleaner 101 is not yet 100% in the first state, the setter sets a new replacement determination timing.

Therefore, regarding the plate shaped cleaner 101 which is not yet the replacement timing, the plate shaped cleaner can be replaced at a suitable timing by a simple method.

In the cleaning apparatus 1000 according to the present embodiment, the notifier notifies to the user that it is the replacement timing when the determiner determines in the replacement determination timing that the percentage of use of the plate shaped cleaner reached 100% in the first state.

Therefore, according to the cleaning apparatus 1000 of the present embodiment, the user is able to replace the plate shaped cleaner at a suitable time by receiving the notification.

In the cleaning apparatus 1000 according to the present embodiment, the replacement timing when the plate shaped cleaner is used only in the first state is to be the first replacement timing, and the replacement timing when the plate shaped cleaner 101 is used only in the second state is to be the second replacement timing. When the replacement determination timing is larger than the second replacement timing, the setter sets the second replacement timing as the replacement determination timing, and the determiner determines that it is the replacement timing when the replacement determination timing is the second replacement timing in the replacement determination timing.

Therefore, for the purpose of maintaining cleaning properties, there is no risk of setting the replacement determination timing to be longer than the second replacement timing in which the replacement timing of the plate shaped cleaner is the longest.

In the cleaning apparatus 1000 according to the present embodiment, the first state is the belt tension state in the black and white mode, and the second state is the belt tension state in the full color mode. The first replacement timing is the replacement timing of the plate shaped cleaner 101 when the plate shaped cleaner 101 reaches the maximum amount of use using only the black and white mode. The second replacement timing is the replacement timing of the plate shaped cleaner 101 when the plate shaped cleaner 101 reaches the maximum amount of use using the full color mode.

Therefore, in the cleaning apparatus provided in the image forming apparatus that is used in the black and white mode and the full color mode, the plate shaped cleaner can be replaced at a suitable timing by a simple method.

In the cleaning apparatus 1000 according to the present embodiment, the first obtainer obtains the amount of use of the plate shaped cleaner 101 based on the number of sheets printed or the rubbing distance between the plate shaped member 101 and the belt shaped member.

Therefore, according to the cleaning apparatus 1000 of the present embodiment, there is no need for a new sensor or a new mechanism in order to obtain the amount of use of the plate shaped cleaner, and the plate shaped cleaner can be replaced at a more suitable timing by a simple method.

In the cleaning apparatus 1000 according to the present embodiment, the belt tension state is determined by the printing mode setting.

Therefore, there is no need for a new sensor or a new mechanism for determining the belt tension state, and the plate shaped cleaner can be replaced at a more suitable timing by a simple method.

The cleaning apparatus 1000 according to the present embodiment includes a second obtainer (controller 10) that obtains at least one of temperature/humidity information near the belt member and an amount of use of the belt shaped member, and the setter sets the replacement determination timing according to at least one of the temperature/humidity information and the amount of use of the belt shaped member.

Therefore, the plate shaped cleaner can be replaced at a suitable timing by a simple method based on at least one of the temperature/humidity information and the amount of use of the belt shaped member.

In the cleaning apparatus 1000 according to the present embodiment, the setter sets the replacement determination timing based on a setting coefficient corresponding to at least one of the temperature/humidity information and the amount of use of the belt shaped member.

Therefore, the plate shaped cleaner can be replaced at a more suitable timing by a simple method based on the setting coefficient corresponding to at least one of the temperature/humidity information and the amount of use of the belt shaped member.

In the cleaning apparatus 1000 according to the present embodiment, the plate shaped cleaner 101 is a metal scraper.

Therefore, according to the cleaning apparatus 1000 of the present embodiment, even when the plate shaped cleaner is a metal scraper in which leak of toner due to edge lifting tends to occur, by setting the replacement determination timing at a suitable timing, it is possible to prevent leaking of toner due to edge lifting.

The image forming apparatus 1 according to the present embodiment includes an image former 4 that forms an image on a sheet P. The image former 4 includes the belt shaped member (intermediate transfer belt T) in which the toner image is formed on the surface, the transferer 46 with which a toner image formed on the surface of the belt shaped member is transferred to the sheet P, and the cleaning apparatus 1000 that removes residual matter that remains on the surface of the belt shaped member after transfer by the transferer 46.

Therefore, the residual matter remaining on the surface of the belt shaped member can be removed by the cleaning apparatus, and it is possible to prevent leaking of the toner.

In the image forming apparatus 1 according to the present embodiment, the belt shaped member is the intermediate transfer belt T. The image forming apparatus 1 includes the primary transfer roller 45 with which primary transfer is performed, and the toner image is transferred onto the intermediate transfer belt T. The primary transfer roller 45 can be pressed to and separated from the inner surface of the intermediate transfer belt T, and the printing mode is switched by the number of primary transfer rollers 45 that are pressed to the intermediate transfer belt T.

Therefore, the plate shaped cleaner can be replaced at a more suitable timing by a simple method in a configuration in which the number of primary transfer rollers 45 pressed against the intermediate transfer belt T is switched depending on the printing mode.

Though the embodiment according to the present invention has been described in detail, the present invention is not limited to the above embodiment, and modifications can be made within the scope of the present invention.

For example, in the above embodiments and modifications, the belt shaped member that the plate shaped cleaner 101 comes into contact with is the intermediate transfer belt T, but the present invention is not limited to the above. The belt shaped member may be a secondary transfer belt or a fixing belt.

According to the above embodiments and modifications, the belt tension state of the belt shaped member is switched by switching between the black and white mode and the full color mode in the printing mode setting, but the present invention is not limited to the above.

As a method to switch the belt tension state, a roller that presses the belt shaped member from the inner surface and applies belt tension may be provided, and the belt tension state may be actively changed by whether the roller is pressing or not, the force of pressing, and the number of rollers. The belt tension state may be passively changed by drive load variation of the belt shaped member due to the paper feeding, or the electrostatic adsorption between the belt shaped member and the transferer by switching of the transfer setting when the printing mode setting is switched (output, pressing force, number of rollers, difference in speed between the belt shaped member).

According to the above embodiments and the modifications, the belt tension state information uses the printing mode setting information but the present invention is not limited to the above.

As a method to obtain the belt tension state information, the belt tension state information can be obtained by detecting an amount of elongation of the belt shaped member by using a strain gauge or the like. Alternatively, the belt tension state information can be obtained by placing a load cell in contact with the belt shaped member and detecting the reaction force from the belt shaped member.

Alternatively, the belt tension state information can be obtained by estimating the belt tension state from the sheet type of the sheet P.

The belt tension state can be obtained by combining a plurality of the above methods to obtain the belt tension state information.

According to the above embodiments and modifications, the amount of use of the plate shaped cleaner 101 is obtained by the controller 10 by obtaining from the storage 6 the number of printed sheets printed by the image forming apparatus 1 for each printing mode or the distance that the plate shaped member 101 rubs against the intermediate transfer belt T, but the present invention is not limited to the above.

The amount of time that the driving motor of the belt shaped member is ON can be obtained as the method to obtain the amount of use of the plate shaped cleaner 101.

In the above described embodiments and modifications, the cleaning apparatus 1000 is provided in the image forming apparatus 1 but the present invention is not limited to the above. The cleaning apparatus 100 can be provided outside the image forming apparatus 1.

The detailed configuration and the detailed operation of the devices included in the image forming apparatus can be suitably changed without leaving the scope of the present invention.

Although embodiments of the present invention have been described and illustrated in detail, the disclosed embodiments are made for purposes of illustration and example only and not limitation. The scope of the present invention should be interpreted by terms of the appended claims.

What is claimed is:

1. A cleaning apparatus comprising: a plate shaped cleaner that comes into contact with a belt shaped member that rotates supported by a roller in a position not opposed to the roller in a surface on an opposite side of a surface where the roller comes into contact with the belt shaped member, wherein the plate shaped cleaner cleans the surface of the belt shaped member, and a hardware processor, wherein the hardware processor obtains an amount of use of the plate shaped cleaner for each belt tension state in the belt shaped member in which the belt tension state is switched, and wherein the hardware processor sets a replacement determination timing of the plate shaped cleaner based on the obtained amount of use of the plate shaped cleaner.

2. The cleaning apparatus according to claim 1, wherein based on the obtained amount of use of the plate shaped cleaner, the hardware processor calculates a percentage of use which is a ratio of an actual amount of use with relation to a maximum amount of use of the plate shaped member set in advance for each belt tension state, and wherein the hardware processor sets the replacement determination timing of the plate shaped cleaner based on the percentage of use of the plate shaped cleaner.

3. The cleaning apparatus according to claim 2, wherein a belt tension state in which the replacement timing of the plate shaped cleaner is the shortest is a first state, and a belt tension state in which the replacement timing of the plate shaped cleaner is the longest is a second state, and wherein the hardware processor sets a shortest timing that the percentage of use of the plate shaped cleaner becomes 100% in the first state to be the replacement determination timing of the plate shaped cleaner.

4. The cleaning apparatus according to claim 3, wherein the hardware processor determines whether it is the replacement timing when it is the set replacement determination timing, and wherein the hardware processor outputs a notification to the user when the hardware processor determines that it is the replacement timing.

5. The cleaning apparatus according to claim 4, wherein the hardware processor determines whether the percentage of use of the plate shaped cleaner reached 100% in the first state when it is the set replacement determination timing, and wherein the hardware processor sets a new replacement determination timing when the percentage of use of the plate shaped cleaner did not reach 100%/a in the first state.

6. The cleaning apparatus according to claim 5, wherein the hardware processor makes a notification to the user that it is the replacement timing when the hardware processor determines that the percentage of use of the plate shaped cleaner reached 100% in the first state in the replacement determination timing.

7. The cleaning apparatus according to claim 4, wherein a replacement timing when the plate shaped cleaner is used in only the first state is to be a first replacement timing, wherein a replacement timing when the plate shaped cleaner is used in only the second state is to be the second replacement timing, wherein the hardware processor sets the second replacement timing to be the replacement determination timing when the replacement determination timing exceeds the second replacement timing, and wherein the hardware processor determines that it is the replacement timing when the replacement determination timing is the second replacement timing in the replacement determination timing.

8. The cleaning apparatus according to claim 7, wherein the first state is a belt tension state in a black and white mode, the second state is a belt tension state in a full color mode, the first replacement timing is the replacement timing of the plate shaped cleaner when the amount of use reaches the maximum amount of use of the plate shaped cleaner by use only in the black and white mode, and the second replacement timing is the replacement timing of the plate shaped cleaner when the amount of use reaches the maximum amount of use of the plate shaped cleaner by use in the full color mode.

9. The cleaning apparatus according to claim 1, wherein the hardware processor obtains the amount of use of the plate shaped cleaner based on a number of printed sheets or a rubbing distance between the plate shaped cleaner and the belt shaped member.

10. The cleaning apparatus according to claim 1, wherein the belt tension state is determined by the printing mode setting.

11. The cleaning apparatus according to claim 1, wherein the hardware processor obtains at least one of temperature/humidity information near the belt shaped member and an amount of use of the belt shaped member, and wherein the hardware processor sets the replacement determination timing according to at least one of the temperature/humidity information and the amount of use of the belt shaped member.

12. The cleaning apparatus according to claim 11, wherein the hardware processor sets the replacement determination timing based on a setting coefficient corresponding to at least one of the temperature/humidity information and the amount of use of the belt shaped member.

13. The cleaning apparatus according to claim 1, wherein the plate shaped cleaner is a metal scraper.

14. An image forming apparatus comprising:

an image former that forms an image on a sheet, wherein the image former includes, a belt shaped member in which a toner image is formed on a surface, a transferer that transfers the toner image formed on the surface of the belt shaped member onto the sheet, and a cleaning apparatus according to claim 1 that removes residual matter remaining on the surface of the belt shaped member after transferring by the transferer.

15. The image forming apparatus according to claim 14, wherein the belt shaped member is an intermediate transfer belt, wherein the image forming apparatus further includes a primary transfer roller that performs primary transfer to transfer the toner image onto the intermediate transfer belt, wherein the primary transfer roller is capable of pressing against and separating from an inner surface of the intermediate transfer belt, and wherein the printing mode is switched by the number of primary transfer rollers that are pressed against the intermediate transfer roller.

16. A non-transitory computer-readable storage medium storing a program causing a computer in a cleaning apparatus to perform the following, the cleaning apparatus including a plate shaped cleaner that comes into contact with a belt shaped member that rotates supported by a roller in a position not opposed to the roller in a surface on an opposite side of a surface where the roller comes into contact with the belt shaped member, wherein the plate shaped cleaner cleans the surface of the belt shaped member, wherein the program causes the computer to perform, obtaining an amount of use of the plate shaped cleaner for each belt tension state in the belt shaped member in which the belt tension state is switched, and setting a replacement determination timing of the plate shaped cleaner based on the obtained amount of use of the plate shaped cleaner.

* * * * *